US005228539A

United States Patent [19]

Wertheim

[11] Patent Number: 5,228,539

[45] Date of Patent: Jul. 20, 1993

[54] ARTICLE RETRIEVAL APPARATUS

[76] Inventor: Sheldon Wertheim, 136-04 71 Rd., Flushing, N.Y. 11367

[21] Appl. No.: 877,795

[22] Filed: May 4, 1992

[51] Int. Cl.[5] ..... B66B 9/20

[52] U.S. Cl. ..... 187/20; 248/328

[58] Field of Search ..... 187/27, 20, 17; 294/74; 248/60, 320, 327, 328, 332, 317; 108/149; 254/391, 415

[56] References Cited

U.S. PATENT DOCUMENTS 3,901,165 8/1975 Schlesinger ..... 248/328

4,872,632 10/1989 Johnson ..... 248/332

4,875,653 10/1989 Connolly ..... 248/332

*Primary Examiner*—Robert P. Olszewski

*Assistant Examiner*—Kenneth Noland

*Attorney, Agent, or Firm*—Leon Gilden

[57] ABSTRACT

An apparatus arranged for positioning between a furniture component and a support wall includes a scoop structure mounted coextensively within a gap between the furniture and support wall is arranged for reciprocation relative to an upper end portion of the furniture component to retrieve articles inadvertently directed into the gap. The apparatus includes a pull tether and support tethers mounted to the scoop structure.

5 Claims, 4 Drawing Sheets

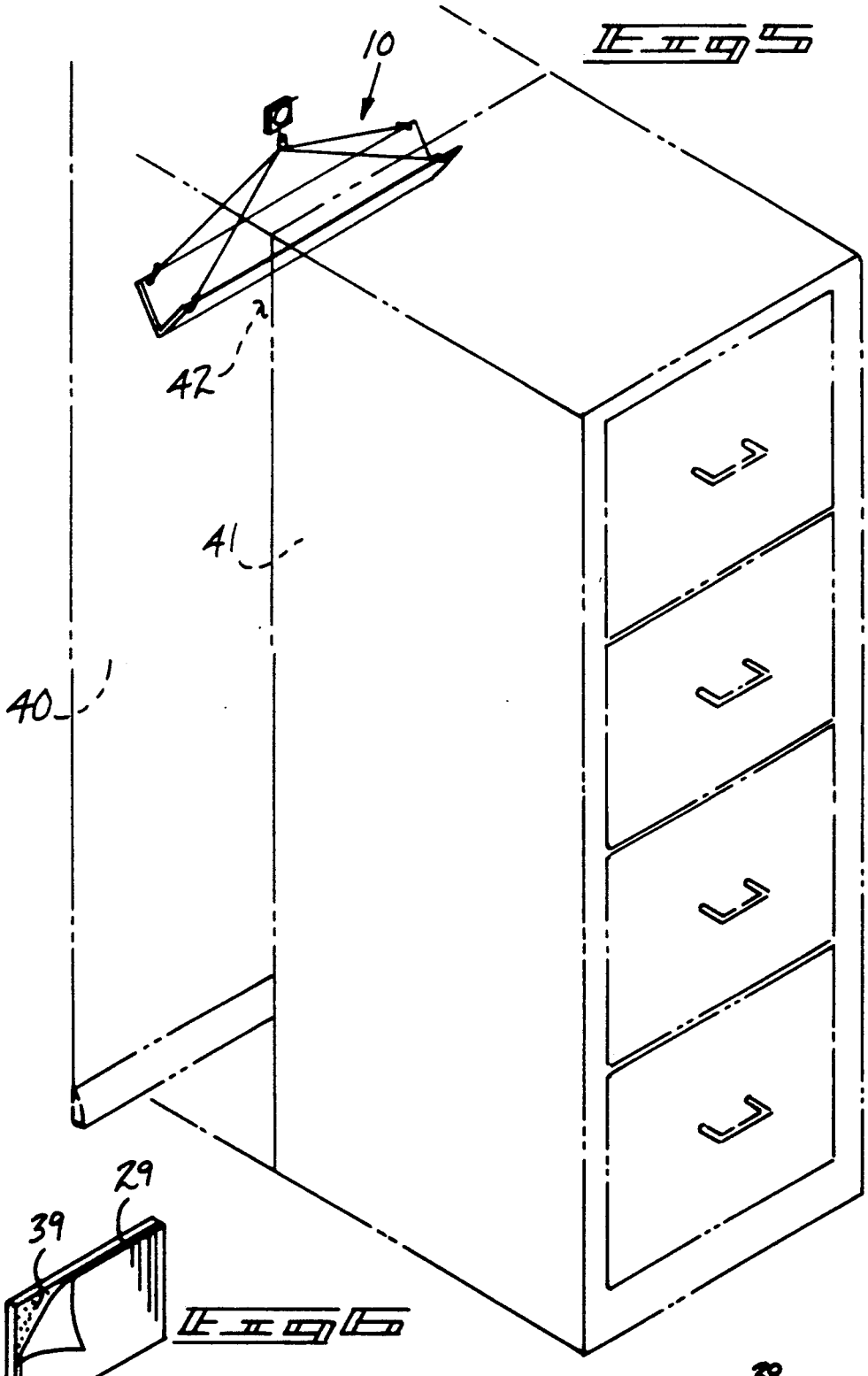
Fig 5
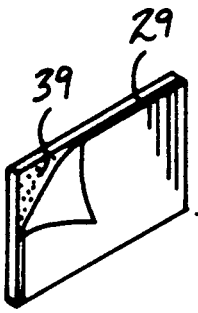
Fig 6
Fig 4
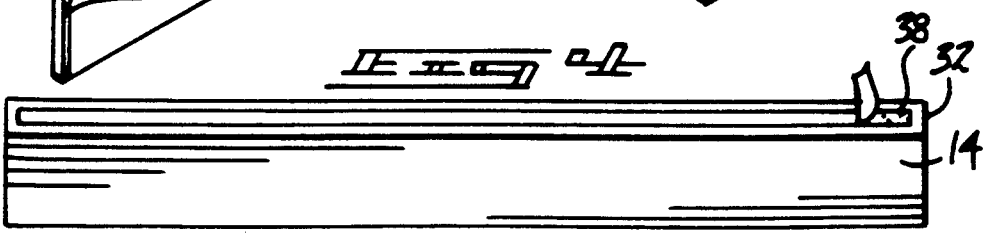

ARTICLE RETRIEVAL APPARATUS

BACKGROUND OF THE INVENTION

1. Field of the Invention

The field of invention relates to retrieval apparatus, and more particularly pertains to a new and improved article retrieval apparatus arranged for positioning between a furniture and wall component within an interior environment of a dwelling and the like.

2. Description of the Prior Art

Various article retrieval apparatus has been available in the prior art for the lifting and access of various components to be retrieved. Such apparatus is exemplified in U.S. Pat. No. 3,707,268 to Kelly wherein a retrieval apparatus includes a winding spool mounted within a housing to retrieve a golf ball when the golf ball is projected relative to the housing.

The instant invention attempts to overcome deficiencies of the prior art by providing for a scoop structure that is reciprocatably mounted within a gap defined between a furniture component and a wall surface to receive articles directed onto the scoop structure and in this respect, the present invention substantially fulfills this need.

SUMMARY OF THE INVENTION

In view of the foregoing disadvantages inherent in the known types of article retrieval apparatus now present in the prior art, the present invention provides an article retrieval apparatus wherein a reciprocatably mounted scoop is positioned between a furniture component and a wall surface to permit access to items directed between the furniture and wall. As such, the general purpose of the present invention, which will be described subsequently in greater detail, is to provide a new and improved article retrieval apparatus which has all the advantages of the prior art article retrieval apparatus and none of the disadvantages.

To attain this, the present invention provides an apparatus arranged for positioning between a furniture component and a support wall, including a scoop structure mounted coextensively within a gap between the furniture and support wall and arranged for reciprocation relative to an upper end portion of the furniture component to retrieve articles inadvertently directed into the gap. The apparatus includes a pull tether and support tethers mounted to the scoop structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved article retrieval apparatus which has all the advantages of the prior art article retrieval apparatus and none of the disadvantages.

It is another object of the present invention to provide a new and improved article retrieval apparatus which may be easily and efficiently manufactured and marketed.

It is a further object of the present invention to provide a new and improved article retrieval apparatus which is of a durable and reliable construction.

An even further object of the present invention is to provide a new and improved article retrieval apparatus which is susceptible of a low cost of manufacture with regard to both materials and labor, and which accordingly is then susceptible of low prices of sale to the consuming public, thereby making such article retrieval apparatus economically available to the buying public.

Still yet another object of the present invention is to provide a new and improved article retrieval apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic view, taken along the lines 4—4 of FIG. 3 in the direction indicated by the arrows.

FIG. 5 is an isometric illustration of the invention in use.

FIG. 6 is an isometric view of adhesive backing relative to the mounting plate utilized by the invention.

DESCRIPTION OF THE PREFERRED EMBODIMENT

Figures 1, 2:
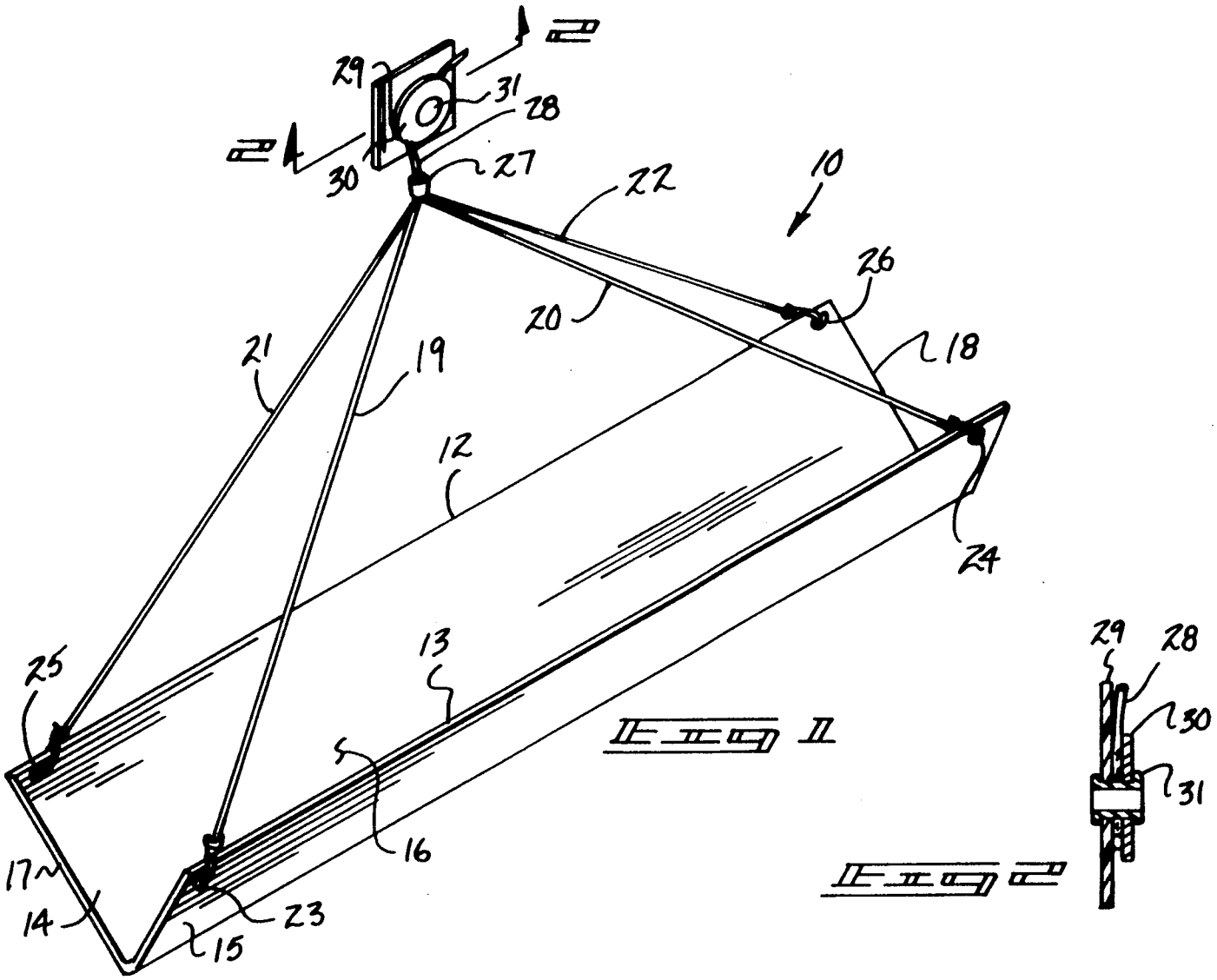
FIG. 1 is an isometric illustration of the instant invention.
FIG. 2 is an orthographic view, taken along the lines 2—2 of FIG. 1 in the direction indicated by the arrows.

With reference now to the drawings, and in particular to FIGS. 1 to 7 thereof, a new and improved article retrieval apparatus embodying the principles and concepts of the present invention and generally designated by the reference numeral 10 will be described.

More specifically, the article retrieval apparatus 10 of the instant invention essentially comprises a rigid base member 11 having a first side edge 12 in a parallel and coextensive relationship relative to a second side edge 13 defining respective upper distal ends of base first and second walls 14 and 15 respectively. A trough cavity 16 is defined between the first and second walls of a generally concave configuration having a substantially V-shaped first end edge 17 spaced from a V-shaped second end edge 18. The first and second end edges 17 and 18 are typically arranged to extend coextensively between side portions of associated furniture component 41 within a gap 42 between the furniture component 41 and a support wall 40, as illustrated in FIG. 5.

Respective first and second support cables 19 and 20 are mounted to respective first and second support apertures 23 and 24 that are adjacent the second side edge 13 and the respective first and second end edges 17 and 18 respectively relative to the first and second support cables 19 and 20. Similarly, third and fourth support cables 21 and 22 have their lower terminal ends pivotally mounted through third and fourth support apertures 25 and 26 adjacent the first side edge 12 and the respective first and second end edges 17 and 18. A collar 27 secures the upper distal ends of the first through fourth support cables 19–22, with a pull cable 28 extending upwardly of the collar 27 wound about a support shaft 31 positioned between an abutment flange 30 and a mounting plate 29 that in turn is secured to a support wall surface 40, as illustrated in FIG. 5.

In this manner, the reeling of the pull cable 28 about the support shaft 31 effects lifting of the base member 11 within the gap 42, as illustrated in FIG. 5, to retrieve articles that have been inadvertently directed into that gap. Subsequent to a lifting, the pull cable is merely wound in a securement manner due to the finite spacing between the abutment flange 30 and the mounting plate 29 to secure the pull cable therein. It should be further noted that a drive motor of various types may be utilized to effect lifting of the cable for convenience of a user of the organization.

Figure 3:
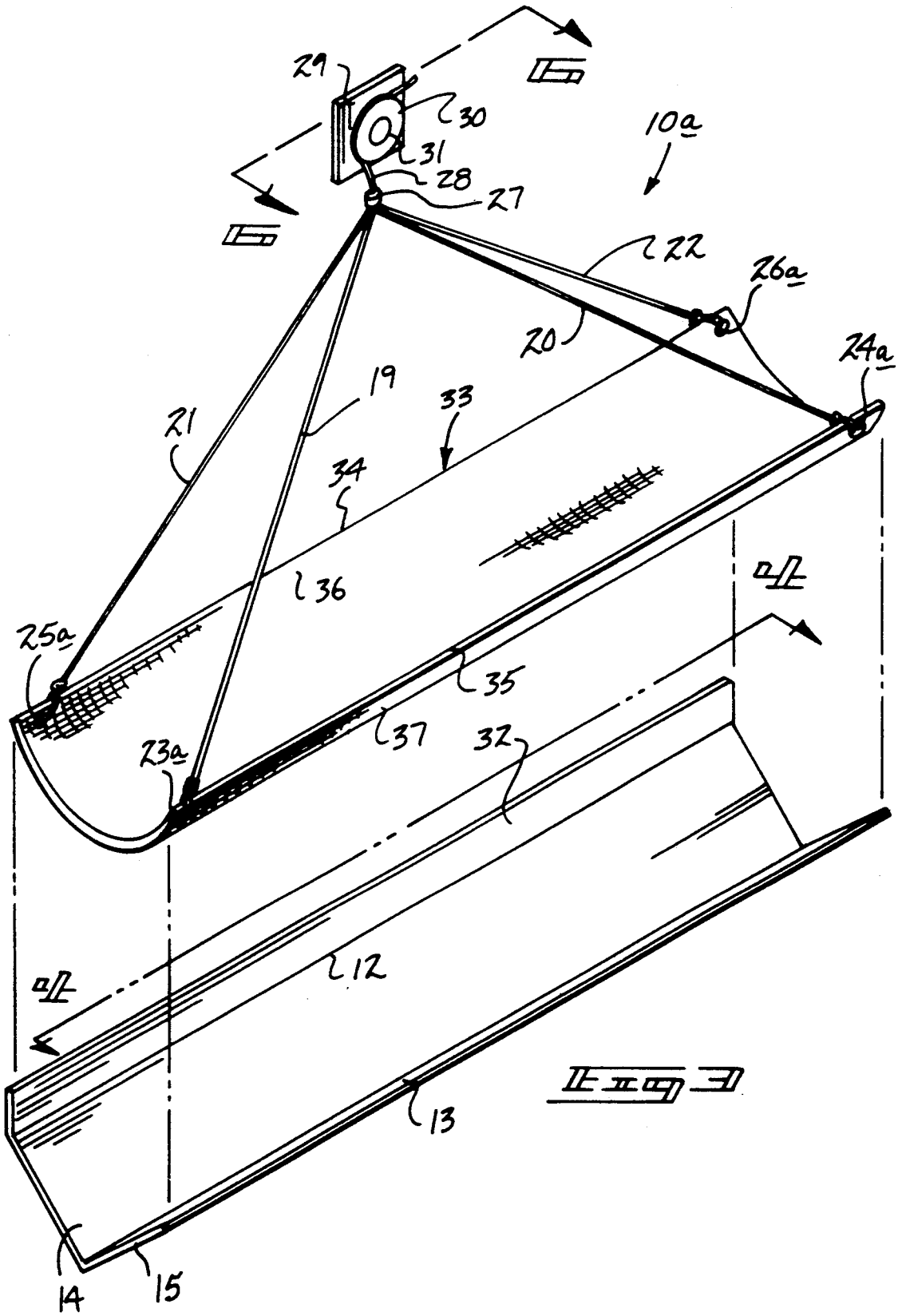
FIG. 3 is an isometric illustration of a modified organization of the invention.

The FIG. 3 illustrates a modified aspect of the invention 10*a*, wherein the base member 11 includes a support cable 32 mounted coextensively to the first side edge 12 extending upwardly thereof, with a adhesive strip 38 secured to a rear surface of the support flange 32 to permit adhesive securement of the base member 11 as required relative to the gap 42.

In the embodiment of the invention as illustrated in FIG. 3, the first through fourth support cables 19–22 are mounted to respective further support apertures 23*a*, 24*a*, 25*a*, and 26*a* directed through a flexible support canopy 32 that includes canopy first side edge spaced from a canopy second edge. The further first and second apertures are directed adjacent the canopy second side edge at opposed ends thereof, with the further third and fourth support apertures 24*a* and 25*a* directed through the support canopy 33 adjacent opposed portions of the first side edge 34. The first and second support apertures 23*a* and 24*a* include a first rib 36 extending longitudinally therebetween, with second rib 37 extending between the further third and fourth support apertures 25*a* and 26*a*. The first and second ribs 36 and 37 are formed of a flexible shape-retentive material to effect a spring back of the ribs in an original longitudinally aligned configuration, as illustrated in FIG. 3, whereupon article components directed upon the canopy between the first and second side edges thereof effects an interfolding of the canopy to provide for a pocket-like structure to maintain grasping of the article when lifted by the pull cable 28 about the support shaft 31, as discussed above.

Figure 7:
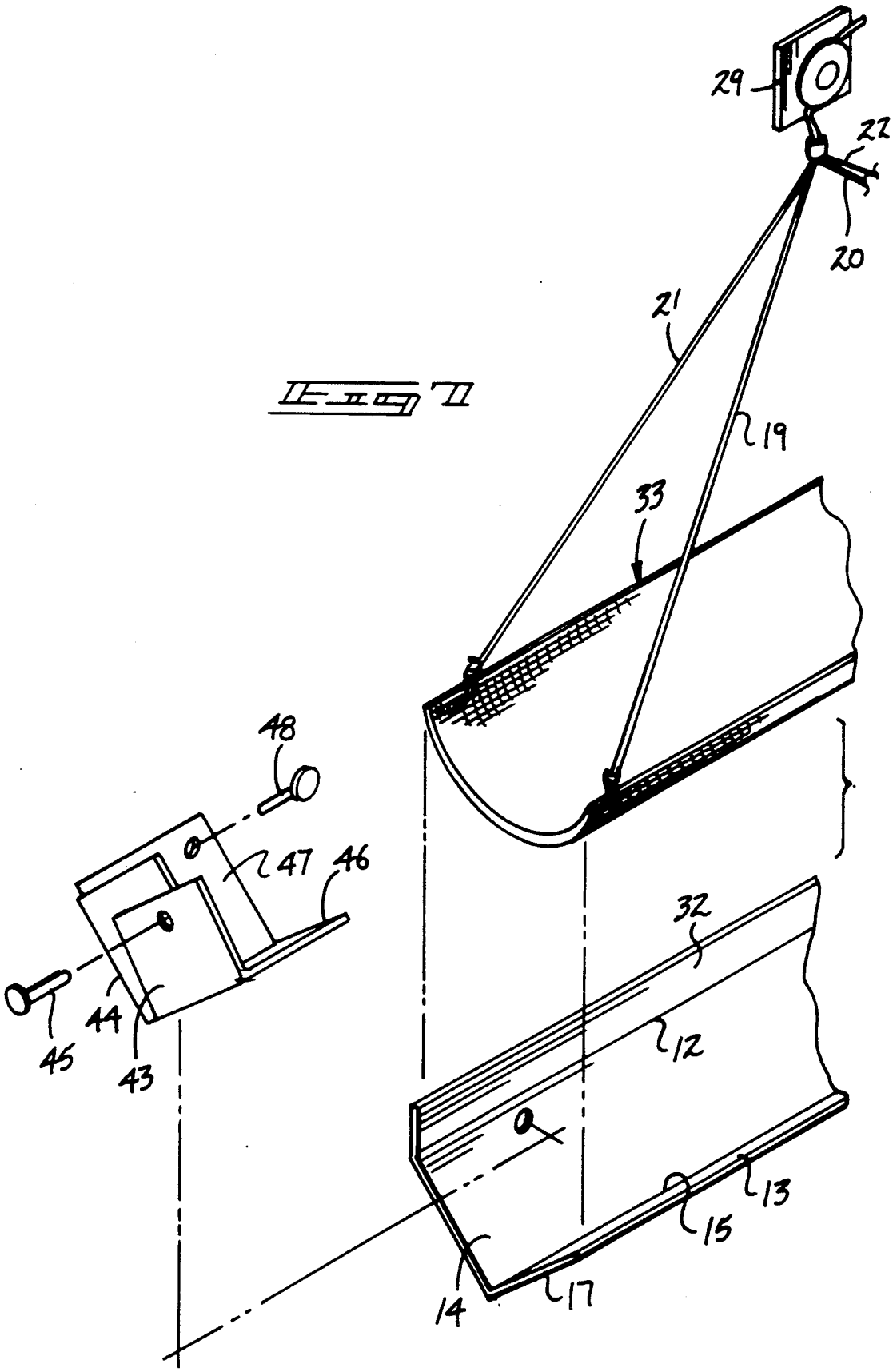
FIG. 7 is an isometric illustration of the invention utilizing end wall structure relative to the underlying trough cavity.

The FIG. 7 illustrates the organization further employing end walls 43 mounted onto the base member 11 to the first and second end edges 17 and 18. For purposes of illustration, only one such base wall is illustrated, but it is understood that the same may be employed in a mirror image relationship relative to the second end edge. The end wall structure includes an end wall outer flap 43 secured to an end wall inner flap 44 by a first fastener, with a first flap support flange 46 mounting the end wall outer flap to the base second wall 15, with a second flap support flange 47 mounting the inner flap 44 to the first wall 14 utilizing a second fastener if required. It should be noted that the support flanges 46 and 47 may utilize adhesive interfacing between the respective first and second base walls 14 and 15 for convenience if required, as well as such adhesive in lieu of the first fastener 45. In this manner, the flexible support canopy 33 is arranged to interfit between the end wall structure between the first and second end edges and is arranged of a length substantially equal to a predetermined length of the base member 11 to secure components under the flexible canopy for subsequent lifting from the gap. Further it should be noted that the mounting plate 29 is typically positioned above the furniture component 41 to provide ease of manual access relative to components within the flexible support canopy 33 when lifted.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An article retrieval apparatus, comprising, a support canopy, the support canopy having a first side edge spaced from a second side edge, and a support canopy first end edge spaced from a canopy second end edge, wherein the support canopy defines a support canopy trough, and a first support cable having a first support cable lower distal end, and a first support aperture directed through the support canopy adjacent the canopy second side edge and the canopy first end edge, and the first support cable lower distal end pivotally mounted through the first support aperture, a second support aperture directed through the support canopy adjacent the canopy second side edge and the canopy second end edge, and a second support cable having a second support cable lower distal end pivotally mounted through the second support apertures, and a third support aperture directed through the canopy adjacent the canopy first side edge and the canopy first end edge, and a third support cable having a third support cable lower distal end pivotally directed through the third support aperture, and a fourth support aperture directed through the canopy adjacent the canopy first side edge and the canopy second end edge, with a fourth support cable having a fourth support cable lower distal end pivotally mounted to the fourth support aperture, and the first support cable, the second support cable, the third support cable, and the fourth support cable joined together to a collar, and a pull cable extending from the collar upwardly thereof above the first support cable, the second support cable, the third support cable, and the fourth support cable, and a support shaft positioned above the collar, with the pull cable wound about the support shaft, wherein the pull cable is arranged for winding about the support shaft to permit selective reciprocation of the support canopy relative to the support shaft, and the support canopy is flexible and includes a first rib extending between the first support aperture and the second support aperture, and a second rib extending between the third support aperture and the fourth support apertures, wherein the first rib and the second rib are each formed of a flexible shape-retentive material to effect spring back to a longitudinally aligned configuration.

2. An apparatus as set forth in claim 1 including a rigid base member, the rigid base member having a base member first side edge and a base member second side edge arranged in a parallel coextensive relationship, with the base member including a base first wall and base second wall extending from the base first side edge to the second side edge at a junction to define a generally V-shaped trough cavity within the base member, wherein the base member is of a predetermined length, and said support canopy is of a length equal to said predetermined length and the support canopy is coextensively oriented relative to the base member.

3. An apparatus as set forth in claim 2 wherein the base member includes a support flange, the support flange extending upwardly of the base member from the base first side edge, and securement means mounted to the support flange for securement of the support flange to a support wall, and permitting positioning of the base member between the support wall and a furniture component.

4. An apparatus as set forth in claim 3 including a mounting plate, the support shaft orthogonally mounted medially of the mounting plate, and an abutment flange mounted about the support shaft in a spaced relationship relative to the mounting plate, with the pull cable wound about the support shaft between the mounting plate and the abutment flange.

5. An apparatus as set forth in claim 4 wherein end wall means is mounted to the base member between the base first side edge and the base second side edge to the base first end edge and the second end edge to maintain securement of components onto the support canopy between the base first end edge and the base send end edge.

* * * * *